US006749283B2

(12) United States Patent
Sanada

(10) Patent No.: US 6,749,283 B2
(45) Date of Patent: Jun. 15, 2004

(54) LIQUID EJECTING DEVICE AND INK JET PRINTER

(75) Inventor: Kazuo Sanada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/097,115

(22) Filed: Mar. 14, 2002

(65) Prior Publication Data

US 2002/0175972 A1 Nov. 28, 2002

(30) Foreign Application Priority Data

Mar. 15, 2001 (JP) ..... 2001-074167

(51) Int. Cl.[7] ..... B41J 2/165
(52) U.S. Cl. ..... 347/28; 347/35
(58) Field of Search ..... 347/11, 28, 29, 347/30, 35, 47

(56) References Cited

U.S. PATENT DOCUMENTS 4,626,869 A * 12/1986 Piatt ..... 347/74
4,947,191 A * 8/1990 Nozawa et al. ..... 347/30
5,412,411 A * 5/1995 Anderson ..... 347/28
6,334,662 B2 * 1/2002 Hollands ..... 347/22
6,474,786 B2 * 11/2002 Percin et al. ..... 347/54

* cited by examiner

*Primary Examiner*—Michael S. Brooke
(74) *Attorney, Agent, or Firm*—Whitham, Curtis & Christofferson, P.C.

(57) ABSTRACT

The liquid ejecting device includes a member in which a plurality of nozzles are formed; a plurality of ejecting units each of which is formed in correspondence with each of the plurality of nozzles and ejects a liquid droplet from each of the plurality of nozzles; and a plurality of supply passages each of which supplies liquid to the plurality of ejecting units. A first liquid level position for a driving period and a second liquid level position for a storage period which are different from each other are set in each of a plurality of liquid flow passages including each of the plurality of nozzles and each of the plurality of supply passages corresponding thereto. Nozzle plugging can be advantageously prevented. The liquid ejecting device can provide an ink jet recording head having a long service life and also an ink jet printer having a long service life.

17 Claims, 6 Drawing Sheets

LIQUID EJECTING DEVICE AND INK JET PRINTER

BACKGROUND OF THE INVENTION

1. Field of the Invention

The present invention relates to the technical field of a liquid ejecting device for use in an ink jet recording head or the like to eject ink droplets or other droplets and, in particular, to a liquid ejecting device with long service life capable of preventing nozzle plugging due to ink precipitation or the like over a long period of time and to an ink jet printer utilizing this liquid ejecting device as the ink jet recording head.

2. Description of the Related Art

A thermal ink jet which rapidly vaporizes a portion of ink through heating with a heater and causes ink droplets to be ejected through a nozzle by its expanding force, etc. is utilized in various printers (See JP 48-9622 A, JP 54-51837 A, etc.).

In another known printer, an oscillation plate is caused to oscillate by a driving device, such as an MEM (micro electronic machine) utilizing static electricity or a piezoelectric element, and ink droplets are ejected through a nozzle by its energy (See JP 11-207956 A, JP 11-309850 A, etc.).

In such an ink jet printer, during storage, for example, when the printer is turned off, leaving the ink jet recording head (hereinafter referred to as the recording head) unattended causes water or other solvent of ink to vaporize, which gives rise to coagulation and precipitation of the solid content (solute) of ink such as dye or pigment, resulting in nozzle plugging (clogging). The clogging of the nozzle leads to a reduction (fluctuation) in the ink ejection amount until the ejection of ink becomes impossible. As a result, the printer cannot function as it should.

In view of this, in an ordinary ink jet printer, capping (sealing) is effected on the nozzle during storage, thereby preventing nozzle plugging. FIG. 9 schematically shows an example of such conventional arrangement.

In the example shown in FIG. 9, when driving the printer (turning it on), a cap 152 for covering the nozzle is spaced apart from a recording head 150 (head unit) so that it may not hinder image recording.

When the printer is turned off, the surface of the recording head 150 in which the nozzles are formed (A large number of nozzles are arranged perpendicular to the plane of the drawing) (hereinafter referred to as the nozzle surface 150*a*) is cleaned by a wiper or the like (not shown), and then the cap 152 is moved to the recording head 150 side to hermetically cover the nozzle surface 150*a*, effecting capping on all the nozzles. In many cases, the cap 152 is connected to a suction device, which sucks the interior of the cap 152 as needed after covering the nozzle surface 150*a*, thereby making it possible to effect capping more reliably.

In the capping of the nozzle of such a recording head 150, equilibrium is reached when the interior of the cap 152 attains saturation vapor pressure. Thereafter, the portion around the nozzles is stabilized, making it possible to prevent nozzle plugging due to ink precipitation or the like.

However, when the capping by the cap 152 is incomplete or when some ink remains around the nozzles as a result of frequent repetition of small amounts of printing, the ink is allowed to gradually vaporize/precipitate around the nozzles, with the result that the nozzles become clogged.

SUMMARY OF THE INVENTION

The present invention has been made with a view toward solving the above problem in the prior art. It is an object of the present invention to provide a liquid ejecting device capable of satisfactorily preventing nozzle plugging due to ink precipitation or the like during storage and little affecting the ink droplet ejection from the nozzles even if ink precipitates during storage, thus realizing an ink jet recording head or the like having a long service life. Another object of the present invention is to provide an ink jet printer utilizing this liquid ejecting device.

In order to attain the object described above, the first present invention provides a liquid ejecting device comprising: a member in which a plurality of nozzles are formed; a plurality of ejecting units each of which is formed in correspondence with each of the plurality of nozzles and ejects a liquid droplet from each of the plurality of nozzles; and a plurality of supply passages each of which supplies liquid to each of the plurality of ejecting units, wherein a first liquid level position for a driving period and a second liquid level position for a storage period which are different from each other are set in each of a plurality of liquid flow passages comprising each of the plurality of nozzles and each of the plurality of supply passages corresponding to the each of the plurality of nozzles.

Preferably, the first and second liquid level positions for the driving and storage periods are adjusted by a pressure adjustor for adjusting a pressure of the liquid.

Preferably, a contact angle at which the liquid comes in contact with an inner wall surface of one of the plurality of liquid flow passages at the first liquid level position for the driving period is different from a contact angle formed at the second liquid level position for the storage period.

Preferably, each of the plurality of liquid flow passages has a larger section size at the second liquid level position for the storage period than at the first liquid level position for the driving period.

Preferably, the second liquid level position for the storage period is set downstream from the first liquid level position for the driving period in a direction in which the liquid is ejected.

Preferably, a groove extending in the direction in which the liquid is ejected is formed in an inner wall surface of each of the plurality of liquid flow passages between the first liquid level position for the driving period and the second liquid level position for the storage period.

Preferably, the liquid is supplied during the storage period through each of the plurality of supply passages or a separately provided liquid supply unit or both of them.

Preferably, the pressure adjustor is provided between a liquid tank to the plurality of supply passages.

Preferably, the liquid is ink, the liquid droplet is an ink droplet, and the liquid ejecting device is an ink jet recording head.

In order to attain the object described above, the second aspect of the present invention provides an ink jet printer having an ink droplet ejecting device as an ink jet recording head, the ink droplet ejecting device comprising: a member in which a plurality of nozzles are formed; a plurality of ejecting units each of which is formed in correspondence with each of the plurality of nozzles and ejects an ink droplet from each of the plurality of nozzles; and a plurality of supply passages each of which supplies ink to each of the plurality of ejecting units, wherein a first ink level position for a driving period and a second ink level position for a storage period which are different from each other are set in each of a plurality of ink flow passages comprising each of the plurality of nozzles and each of the plurality of supply passages corresponding to the each of the plurality of nozzles.

Preferably, the first and second ink level positions for the driving and storage periods are adjusted by a pressure adjustor for adjusting a pressure of the ink.

Preferably, a contact angle at which the ink comes in contact with an inner wall surface of one of the plurality of ink flow passages at the first ink level position for the driving period is different from a contact angle formed at the second ink level position for the storage period.

Preferably, each of the plurality of ink flow passages has a larger section size at the second ink level position for the storage period than at the first ink level position for the driving period.

Preferably, the second ink level position for the storage period is set downstream from the first ink level position for the driving period in a direction in which the ink is ejected.

Preferably, a groove extending in the direction in which the ink is ejected is formed in an inner wall surface of each of the plurality of ink flow passages between the first ink level position for the driving period and the second ink level position for the storage period.

Preferably, the ink is supplied during the storage period through each of the plurality of supply passages or a separately provided ink supply unit or both of them.

Preferably, the pressure adjustor is provided between an ink tank to the plurality of supply passages.

DETAILED DESCRIPTION OF THE PREFERRED EMBODIMENTS

Preferred embodiments of a liquid ejecting device of the present invention and of an ink jet printer of the present invention using this liquid ejecting device will now be described in detail with reference to the accompanying drawings.

In the following, the liquid ejecting device of the present invention will be described as applied to a so-called thermal ink jet recording head which causes nucleate boiling of ink through heating by a heater and which ejects ink through nozzles by its expanding force and bursting force.

This description, however, should not be construed restrictively. The present invention is also applicable with advantage to other devices than an ink jet recording head, such as a processing liquid coating device and a spray coating device, as long as they are of the type which includes a nozzle, a liquid ejecting unit for ejecting liquid through the nozzle, and a supply passage for supplying liquid to the liquid ejecting unit and the nozzle.

Further, apart from the heater, it is also possible to adopt various types of liquid ejecting units, such as a unit utilizing an oscillation plate, an MEM (micro electronic machine) for oscillating the oscillation plate, a piezoelectric element, etc.

Apart from a thermal ink jet as in the example shown, the liquid ejecting device of the present invention is applicable to various types of ink jet recording heads. For example, it is also preferably applicable to the ink jet recording heads as disclosed in JP 5-50601 A, JP 11-207956 A, JP 11-309850 A, etc., which have an ink chamber with nozzles, one wall of this ink chamber being formed as an oscillation plate to be caused to oscillate by an MEM, a piezoelectric element or the like, ink being ejected from the nozzles by the oscillation energy, and ink flowing into the ink chamber.

In the example shown, the present invention is applied to a so-called top shooter type (face ink jet) ink jet recording head which ejects ink in a direction substantially perpendicular to the Si substrate surface (the direction in which liquid supply to the nozzles is effected). Apart from this, the present invention is also applicable to a side shooter type (edge ink jet) ink jet recording head as disclosed in JP 11-263014 A, etc., which ejects ink substantially parallel to the Si substrate surface.

Further, the present invention is also applicable to a small ink jet recording head compatible with a carriage type printer in which scanning is effected by a carriage in a direction perpendicular to the nozzle row in combination with intermittent conveyance of ink jet recording sheets or image receiving sheets (hereinafter collectively referred to as the recording sheets). Alternatively, the present invention is applicable to a so-called line head in which a nozzle row extends in correspondence with the entire one side area of the recording sheet (or an area extending beyond that).

Figure 1A:
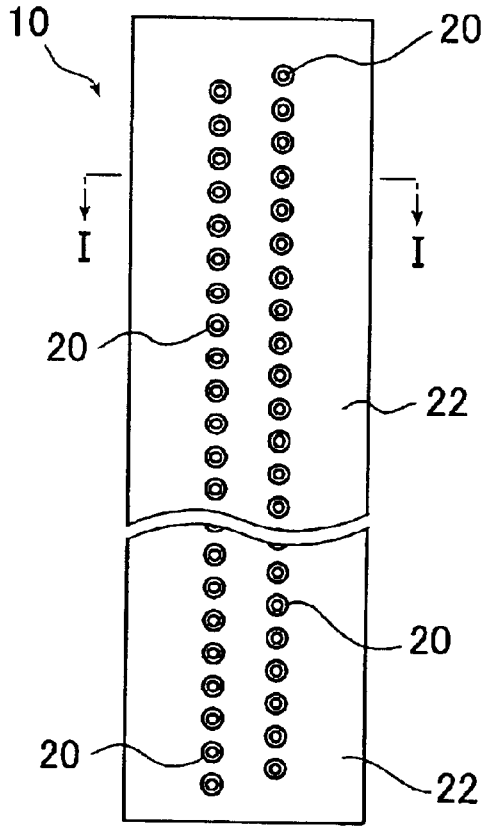
FIG. 1A is a plan view schematically showing an example of an ink jet recording head according to the present invention.
Figure 1B:
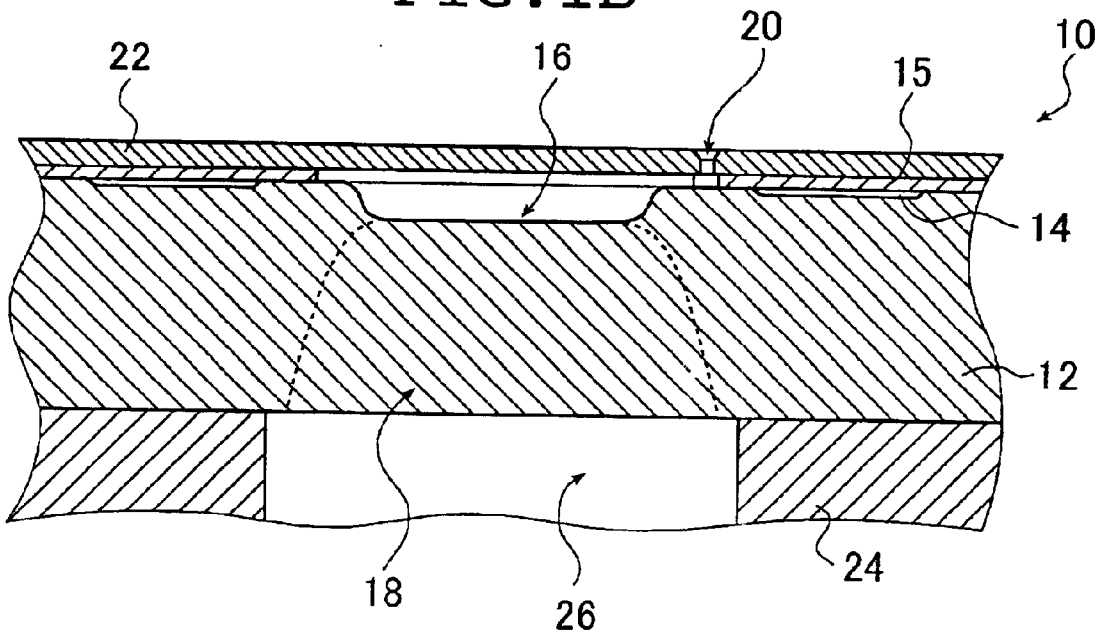
FIG. 1B is a sectional view taken along the line I—I of FIG. 1A.

FIGS. 1A and 1B schematically show an example of an ink jet recording head according to the present invention. FIG. 1A is a plan view of the ink jet recording head as seen from the ink ejecting (flying) direction, and FIG. 1B is a sectional view taken along the line I—I of FIG. 1A.

The ink jet recording head 10 shown in FIGS. 1A and 1B (hereinafter referred to as the recording head 10) has a large number of nozzles 20 arranged in one direction (a direction perpendicular to the plane of the drawing in FIG. 1B), and there are two rows of nozzles 20 (hereinafter referred to as the nozzle rows), thereby achieving an improvement in terms of recording density.

As described below, in the example shown, the nozzles 20 are formed in an orifice plate 22 laminated on an Si substrate 12 (partition 15).

In the recording head 10 of the present invention, the number of nozzle rows is not restricted to two. The number of nozzle rows may be one or three or more. Further, the colors of the inks ejected from the respective nozzle rows and a combination thereof can be arbitrarily determined.

The recording head 10 shown is prepared on the Si substrate 12 by utilizing a semiconductor device manufacturing technique, and heaters 30 (See FIGS. 2A and 2B) formed in correspondence with the respective nozzles 20 and serving as ink ejecting units, a driving LSI 14 for driving the heaters 30, etc. are formed on the Si substrate 12.

Further, formed on the Si substrate 12 are an ink groove 16 for supplying ink to the respective heaters 30 (and nozzles 20), and ink supply holes 18 for supplying ink to the ink groove 16.

The ink groove 16 extends in a direction in which the nozzle rows extend and is formed by cutting the surface (the ink ejection side surface) of the Si substrate 12. A plurality of ink supply holes 18 extend through the Si substrate 12 so as to communicate with the ink groove 16 from the rear surface and are arranged at predetermined intervals in the direction of the nozzle rows.

A partition 15 for forming individual ink supply passages 28 for the respective heaters 30 is laminated on the Si substrate 12. The partition 15 will be described in detail below.

On the partition 15 (Si substrate 12), there is laminated and glued an orifice plate 22 in which the nozzles 20 are formed (pierced).

The material of the orifice plate 22 and the partition 15 can be selected from various known materials. It may, for example, be polyimide.

The Si substrate 12 (Si chip) is attached/fixed (mounted) to a predetermined position of a frame 24 serving as a support member. This frame 24 is mounted to a predetermined position of a head unit (e.g., so-called cartridge) of an ink jet printer (not shown).

In the frame 24 and the head unit, there is formed an ink supply passage (ink flow passage 26 in the frame 24) for supplying ink to the ink supply holes 18 formed in the Si substrate 12.

Figure 2A:
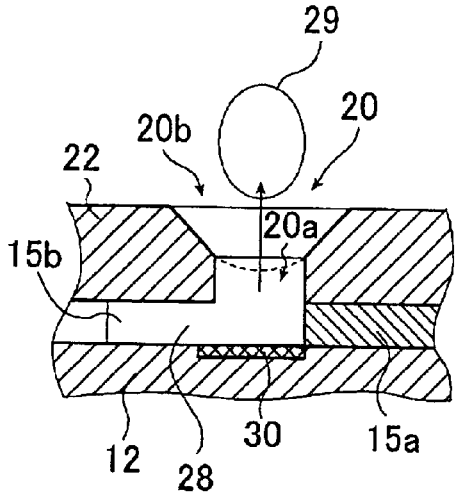
FIGS. 2A and 2B are partially enlarged views of FIG. 1B.
Figure 2B:
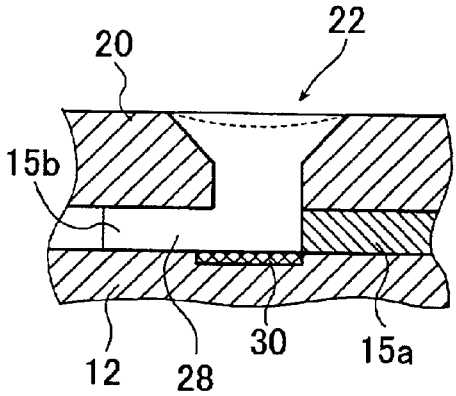

FIGS. 2A and 2B are sectional views schematically showing the portion around the nozzle 20 of the recording head 10.

As stated above, in the recording head 10, the heaters 30 for ejecting ink are formed on the Si substrate 12.

Further, as stated above, laminated on the Si substrate 12 is the partition 15 for forming the individual ink supply passages 28 to the respective heaters 30 (nozzles 20). In the example shown, the partition 15 includes a region covering the entire surface on the opposite side of the nozzle 20 with respect to the ink groove 16. To be more specific, the partition 15 in the example shown includes a front wall portion 15*a* for closing the forward end of the ink groove 16 and a lateral wall portion 15*b* for forming the individual ink supply passages 28 to the respective heaters 30 (and the nozzles 20 corresponding thereto) The lateral wall portion 15*b* protrudes from the front wall portion 15*a* toward the ink groove 16 in each of the nozzles 20 so that the adjacent nozzles 20 can be separated from each other.

Further, laminated on the partition 15 is an orifice plate 22 in which the nozzles 20 (nozzle rows) are formed.

In this recording head 10, ink supplied from an ink tank attached to the head unit by a predetermined route is conveyed by way of the ink supply passage 26 of the frame 24 and supplied to the ink supply holes 18 from the rear surface side of the Si substrate 12 before being introduced to the ink groove 16 formed in the surface of the Si substrate 12.

The ink supplied to the ink groove 16 reaches the individual ink supply passages 28 separated from each other for the respective heaters 30 by the lateral wall portion 15*b* of the partition 15, and ejected through the corresponding nozzles 20 in the form of ink droplets 29 by nucleate boiling caused through heating by the respective heaters 30 which are driven by the driving LSI 14.

The recording head 10 thus constructed is described in detail in JP 6-71888 A, JP 6-297714 A, JP 7-227967 A, JP 8-20110 A, JP 8-207291 A, JP 10-16242 A, etc.

Here, in the example shown, each nozzle 20 does not consist of a straight pipe but preferably of a straight pipe region 20*a* on the upstream side (hereinafter referred to as the lower portion) with respect to the ink ejecting direction (ink moving (ejecting) direction) and a diverging region 20*b* formed above (i.e., on the downstream side of) the straight pipe region 20*a* and gradually diverging upwards.

In the liquid ejecting device of the present invention, the liquid levels are set to be different during driving and during storage. In the recording head 10 shown, the ink surface is set at the upper end of the straight pipe region 20*a* as indicated by the dotted line in FIG. 2A during driving, and is set at the upper end of the diverging region 20*b* as indicated by the dotted line in FIG. 2B during storage.

In the present invention, it is possible, for example, to regard the period during which the ink jet printer (liquid ejecting device) is on as the driving period and to regard the period during which it is off as the storage period. Alternatively, it is possible to regard the period during which printing operation is performed (including the intervals when printing is successively performed on a plurality of sheets) as the driving period and to regard the rest of the period as the storage period. Further, it is possible to enable the operator of the ink jet printer to select between the driving and storage modes.

The above arrangement can be appropriately determined according to the performance required of the ink jet printer (image quality and service life), the ink property (precipitation characteristic, etc.), the performance of the cleaning device, etc. provided in the ink jet printer, etc.

As stated above, in an ink jet printer, nozzle plugging (clogging) as a result of precipitation of ink (solid content) due to its evaporation/coagulation during storage is prevented by performing capping on the nozzles. However, when the capping is incomplete or when some ink is allowed to remain around the nozzles as a result of repeated inactive processing in small quantities, the ink precipitating around the nozzles is accumulated, resulting in nozzle plugging.

In the recording head 10 of the present invention, the ink level is set to be different between storage period and driving period. Thus, if ink precipitates at the storage liquid level, no ink precipitation occurs on the inner wall of the liquid level at the time of ejection, which greatly influences the ejection through the nozzles 20. That is, fluctuations or the like in the ink ejection amount due to clogging of the nozzles 20 can be satisfactorily prevented, thereby realizing a recording head 10 having a long service life.

In the preferred example shown, the liquid surface diameter (duct size) during storage is larger than that during driving. Due to this arrangement, if ink precipitates on the liquid surface during storage, it is possible to more reliably prevent fluctuations in ink ejection amount due to clogging of the nozzles 20 and clogging of the nozzles 20.

The example shown is particularly preferable in that in addition to the difference in liquid surface diameter in the nozzle 20, the liquid level during storage is higher than that during driving to effect capping on the nozzles through so-called liquid stopping. This makes the above effect more remarkable. Further, the inner wall corresponding to the liquid level during driving is always wet with ink, so that the ink ejecting operation is stabilized.

In the present invention, there is no particular restriction regarding the method of controlling the ink (liquid) surface during storage and driving, and it is possible to adopt variety of methods. Generally speaking, the liquid level in a liquid duct is determined according to the contact angle of the liquid and the duct inner wall (wettability), duct configuration, the pressure on the duct, etc. The liquid level can be controlled in various ways using these factors.

An exemplary method includes controlling the ink level in the nozzle 20 by providing a pressure adjustor (see reference numeral 111 in FIG. 7A) in a part of or at some midpoint of the ink supply passage connecting the ink tank (see reference numeral 112 in FIG. 7A) attached to the head unit (see reference numeral 110 in FIG. 7A) to the ink supply holes 18 formed in the Si substrate 12. In other words, an expansible, shrinkable or elastic region may be provided in a part of the ink supply passage connecting the ink tank to the ink supply holes 18 together with a device for pressurizing (or expanding) this region so that the pressure to be applied to ink (internal pressure of ink) can be adjusted depending on whether this region is pressurized or not, thus controlling the ink level.

It is also possible to provide at some midpoint in the ink flow passage from the ink tank attached to the head unit to the heaters 30 a closed ink reservoir communicating with the ink flow passage so that the ink pressure can be adjusted by changing the volume of this ink reservoir to thereby control the ink level.

Further, by adjusting the height of the ink tank attached to the head unit (e.g., between high and low positions), it is preferable to adjust the ink pressure in the ink flow passage to thereby adjust the ink level.

It is also preferable to control the ink level by changing the contact angle of the inner wall and the ink between driving period and storage period. For example, in the example shown in FIG. 2, it is possible to make the inner wall surface of the straight pipe region 20*a* of the nozzle 20 hydrophilic (for decreasing the contact angle) and to make the diverging region 20*b* hydrophobic (for increasing the contact angle). In this case, it is desirable to make the surface of the orifice plate 22 in which the nozzle rows are formed (that is, the nozzle surface) more hydrophobic. The contact angle is adjusted through selection of material and well-known processing for making a surface hydrophilic or hydrophobic.

In the present invention, it is more desirable to perform both such pressure control and the contact angle selection for liquid level control.

Figure 3A:
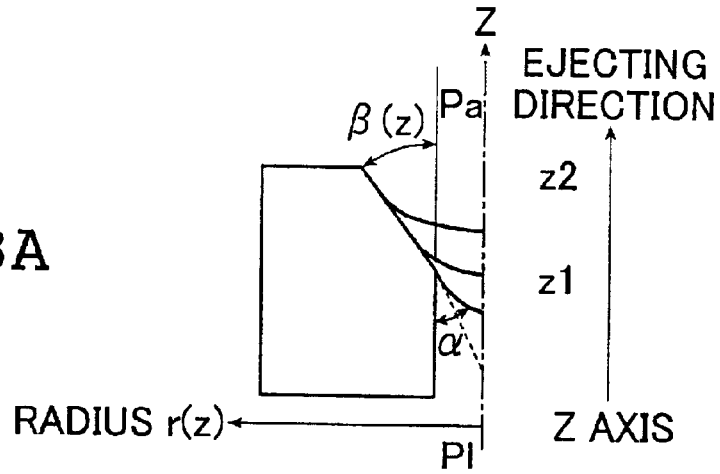
FIG. 3A is a schematic diagram illustrating the relation between the pressure, contact angle and nozzle configuration when the liquid level is controlled in a nozzle of the ink jet recording head shown in FIGS. 1A and 1B with reference to the right half of the cross section of the nozzle.

The relation between the pressure, contact angle and nozzle configuration when the liquid level is controlled is now described by using the right half of the cross section of the nozzle schematically shown in FIG. 3A.

In FIG. 3A, z axis is taken in the ejecting direction from the lower end of the nozzle 20 parallel to the center line of the nozzle 20, and r (radius) axis is taken in the radial direction from the center line of the nozzle 20. When T is the surface tension of ink (liquid), Pl is the internal pressure on the ink side, Pa is the atmospheric pressure, $\alpha(z)$ is the contact angle between ink and the inner wall surface of the nozzle 20, $\beta(z)$ is the change in the configuration of the nozzle 20, and r(z) is the radius of the nozzle 20, the following equations (1) and (2) are given:

$$\{2T\cos(\alpha(z)+\beta(z))\}/r(z)=Pt \quad (1)$$

$$Pa-Pt=Pl \quad (2)$$

where Pt is the apparent pressure due to the surface tension of ink and represents the differential pressure between the atmospheric pressure and the ink internal pressure. The origin of z axis is the lower end (upstream end) of the nozzle 20 and z axis represents the height from the lower end of the nozzle 20. The origin of r axis is the center of the nozzle 20.

Therefore, the following equation (3) is given:

$$\{2T\cos(\alpha(z)+\beta(z))\}/r(z)=Pa-Pl \quad (3)$$

The ink level tends to stay still at the position z determined by the equation (3).

Two combinations of the contact angle $\alpha$, the configuration change $\beta$ and the internal pressure Pl of ink are preferably set so that the equation (3) is met when z=z1 and z=z2 where z1 is the position of the ink level during ejection and z2 is the position of the ink level during storage.

Figure 3B:
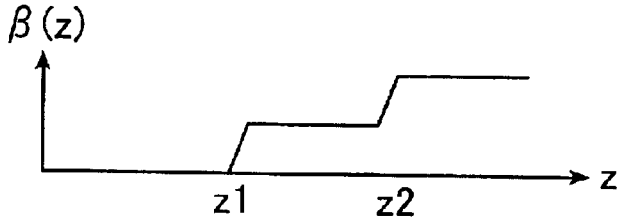
FIG. 3B is a graph showing the change in the configuration of the nozzle shown in FIG. 3A.
Figure 3C:
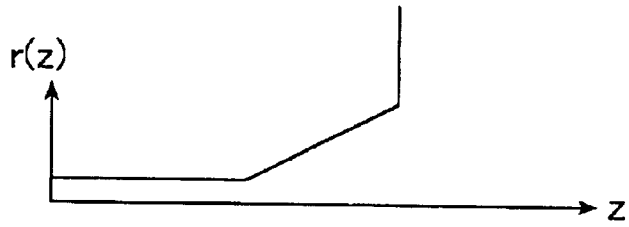
FIG. 3C is a graph showing the radius of the nozzle shown in FIG. 3A.
Figure 3D:
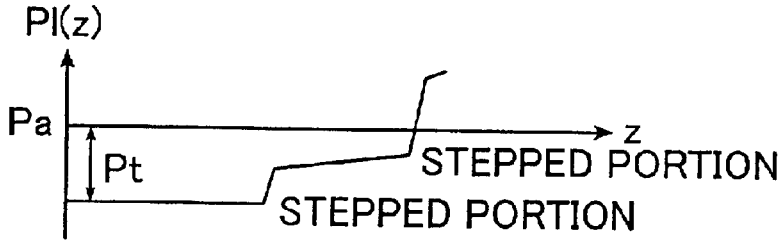
FIG. 3D is a graph showing the internal pressure on the ink side.

A graph of the configuration change $\beta(z)$, a graph of the radius r(z) and a graph of the internal pressure Pl on the ink side in the nozzle 20 shown in FIG. 3A are thus shown in FIGS. 3B, 3C and 3D, respectively.

Therefore, as shown in FIG. 3D, the ink level is stabilized in the stepped portions formed in z1 and z2, since the equation (3) is met. To be more specific, when the internal pressure Pl of ink is on the lower side of the graph shown in FIG. 3D (takes a large negative value or large absolute value), the ink level is moved and the internal pressure of ink is stabilized in the stepped portion formed when z=z1. On the contrary, when the internal pressure Pl of ink takes a small negative value (small absolute value) or takes a positive value, the ink level is moved and the internal pressure of ink is stabilized in the stepped portion formed when z=z2.

In light of the equations (1) and (3), the contact angle $\alpha(z)$ between ink and the inner wall surface of the nozzle 20 and the configuration change $\beta(z)$ of the nozzle 20 have of course similar effects and as a result, pressure retention is possible as far as the differential pressure Pt falls within the stepped portions shown in FIG. 3D. Therefore, the present invention may use the structure depending on both or one of the contact angle $\alpha(z)$ and the configuration change $\beta(z)$.

The contact angle $\alpha(z)$ or the configuration change $\beta(z)$ may be set with respect to the internal pressure Pl of ink at the position during ejection z1 and the position during storage z2. Alternatively, the internal pressure Pl of ink may be adjusted with respect to the contact angle $\alpha(z)$ and the configuration change $\beta(z)$ at the position during ejection z1 and the position during storage z2.

Figure 2C:
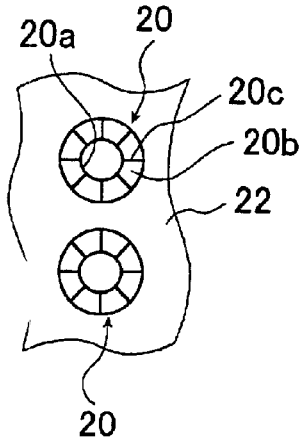
FIG. 2C is a schematic plan view of another example of an ink jet recording head according to the present invention.

When, as in the example shown, the liquid level during storage is higher than that during driving, it is desirable to form in the inner wall of the nozzles 20 grooves 20*c* extending from the liquid level during driving to the liquid level during storage as shown in the plan view of FIG. 2C.

Due to this construction, it is possible to effect ink surface movement between the driving and storage modes more smoothly and reliably. That is, the ink level control during driving and storage can be performed in a more satisfactory manner.

When the liquid level during storage is higher than that during driving, it is possible to provide an ink supply unit for the nozzles 20.

Figure 4A:
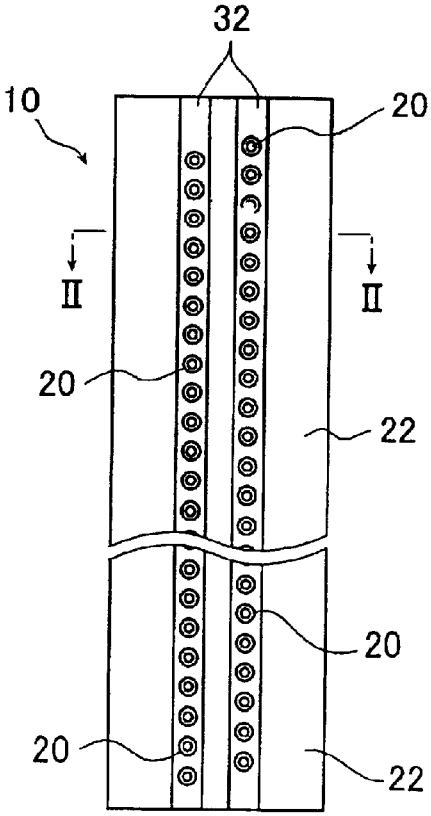
FIG. 4A is a plan view schematically showing another example of an ink jet recording head according to the present invention.
Figure 4B:
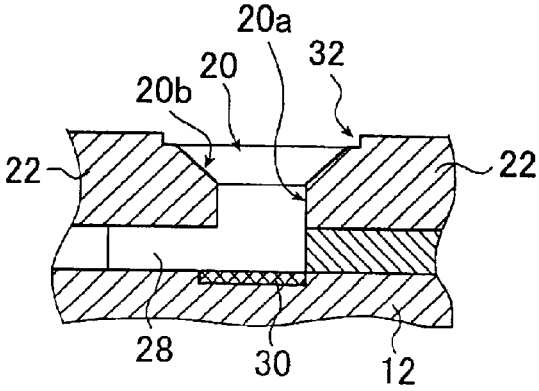
FIG. 4B is a sectional view taken along the line II—II of FIG. 4A.

For example, as shown in FIGS. 4A and 4B, it is possible to form in the surface of the orifice plate 22 supply grooves 32 communicating with the nozzles 20, for supplying ink through these supply grooves 32 during storage. In this case, the ink level during storage may be the upper end of the nozzles 20, and the liquid level during storage may be set at a position where the nozzles 20 are completely immersed in ink.

Alternatively, as described below, it is possible to use a cap 132 of the ink jet printer as the ink supply unit.

While in the recording head 10 shown, each nozzle 20 has the straight pipe region 20*a* and the diverging region 20*b*, this should not be construed restrictively. In the present invention, the nozzle may only have the straight pipe region not the diverging region. Alternatively, the nozzle may have the configuration in which there is no straight pipe region but the nozzle size gradually increases from the lower end toward the upper end.

Figure 5A:
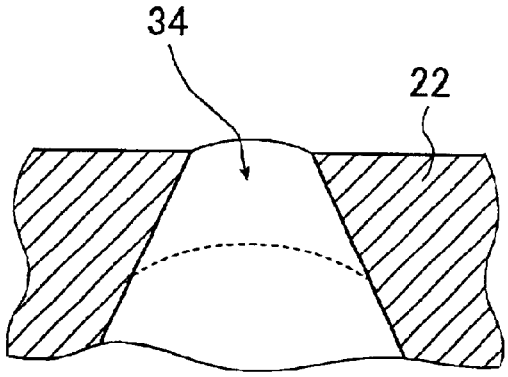
FIGS. 5A, 5B, 5C, 5D, and 5E are schematic diagrams showing other examples of the nozzle configuration of the ink jet recording head of the present invention.

Conversely, as in the case of the nozzle 34 shown in FIG. 5A, it is also possible for the nozzle to gradually converge upwards, and it is desirable, for example, to set the ink level during driving at the upper end of the nozzle 34 as indicated by the solid line, and to set the ink level during storage lower than that (that is, at the position on the upstream side where the diameter is larger than that during driving) as indicated by the dotted line. Further, in this case, it is desirable to make the portion of the inner wall of the nozzle 34 above the liquid level during storage hydrophobic (for increasing the contact angle $\alpha$) and to make the portion below that level hydrophilic (for decreasing the contact angle $\alpha$).

In this particular case, it is further desirable to make the surrounding regions of the nozzle 34 in the outer surface of the orifice plate 22 more hydrophobic than the upper region of the inner wall of the nozzle 34 (the liquid level during storage). Meanwhile, the lower region of the inner wall of the nozzle 34 where it is to be hydrophilic may be a straight pipe region.

Figure 5B:
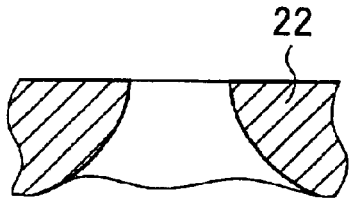
Figure 5C:
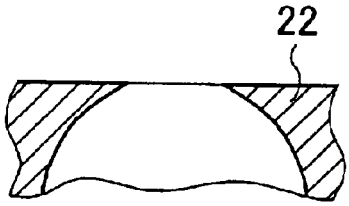
Figure 5D:
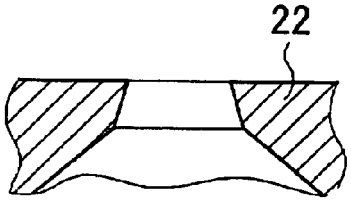
Figure 5E:
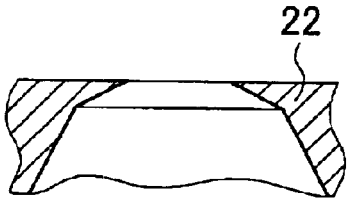

Further, the diverging region and the converging region of the nozzle is not necessarily linear as in the example shown. As shown, for example, in FIGS. 5B and 5C, they may be of a curved configuration, or, as shown in FIGS. 5D and 5E, a stepped configuration.

Figure 6:
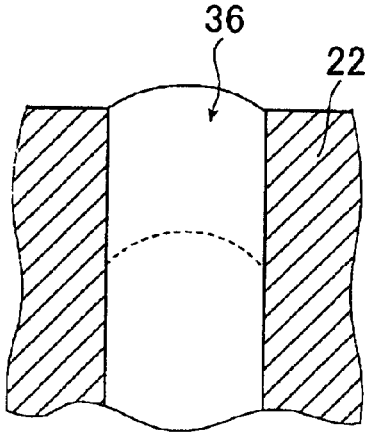
FIG. 6 is a schematic diagram showing another example of the nozzle configuration of the ink jet recording head of the present invention.

Further, as in the examples shown in FIGS. 2 and 6, in the recording head of the present invention, the liquid surface diameter (duct size) during storage and that during driving are not necessarily different. The liquid surface diameters may be the same.

For example, as in the case of the nozzle 36 shown in FIG. 6, it is possible to form the nozzle as a straight pipe and to set the liquid levels at the upper end as indicated by the solid line and at some midpoint of the pipe as indicated by the dotted line. Alternatively, it is possible to set the liquid levels at some midpoint of the pipe and the lower end thereof, or at two positions between the upper and lower ends of the pipe.

In this case, the upper and lower liquid levels may constitute either the liquid level during storage or that during driving. It is desirable that the portion of the inner wall surface of the nozzle 36 below the lower liquid level be hydrophilic (for smaller contact angle $\alpha$) and that the portion thereof above the liquid level be hydrophobic (for larger contact angle $\alpha$). More preferably, the surface of the orifice plate 22 is made more hydrophobic (for larger contact angle $\alpha$). This makes it possible to restrain ink precipitation in a more satisfactory manner and to increase the service life of the recording head.

This recording head 10 can be manufactured by a well-known method.

For example, by utilizing a semiconductor device manufacturing technique, there are formed on the Si wafer (Si substrate 12) the heaters 30, the driving LSI 14, the ink groove 16, the ink supply holes 18, the partition 15, etc. in correspondence with a large number of recording heads 10. Then, the orifice plate 22 with no nozzles 20 is laminated/glued, and the nozzles 20 are formed by photolithography in correspondence with the respective recording heads 10 to complete a large number of Si chips constituting the recording heads 10.

Thereafter, each chip is obtained by cutting through dicing of the Si wafer. Further, mounting, wiring, etc. are performed at predetermined positions of the frame 24 for each recording head 10.

Figure 7A:
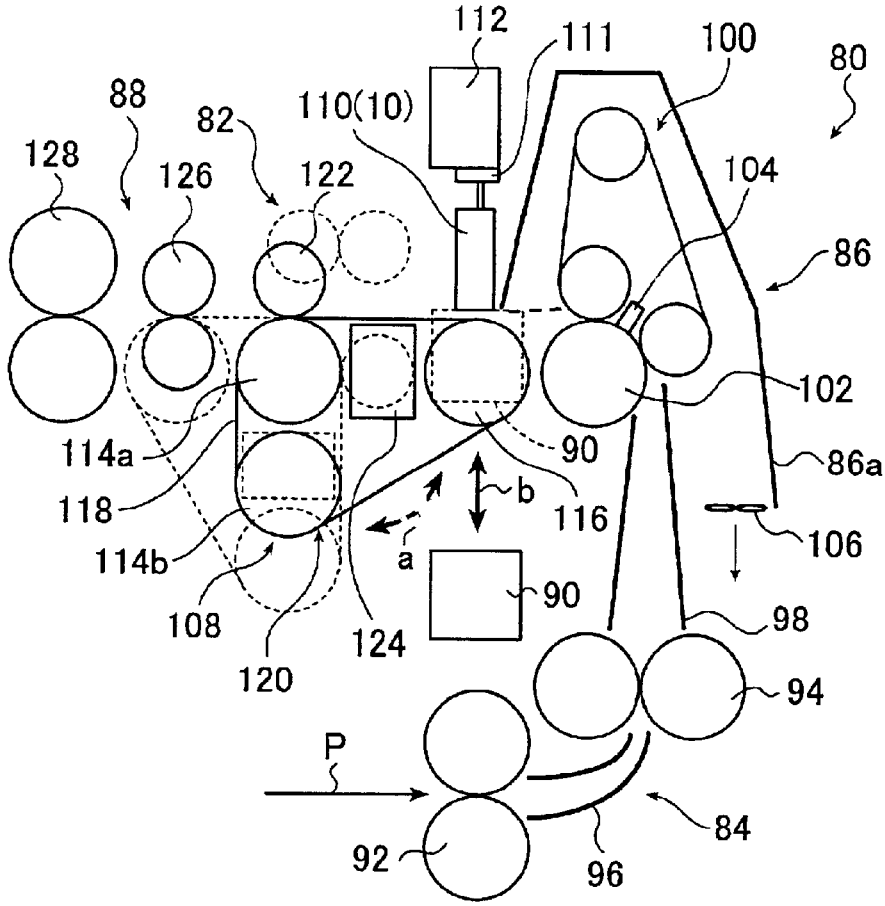
FIG. 7A is a conceptual side view of an example of an ink jet printer according to the present invention.
Figure 7B:
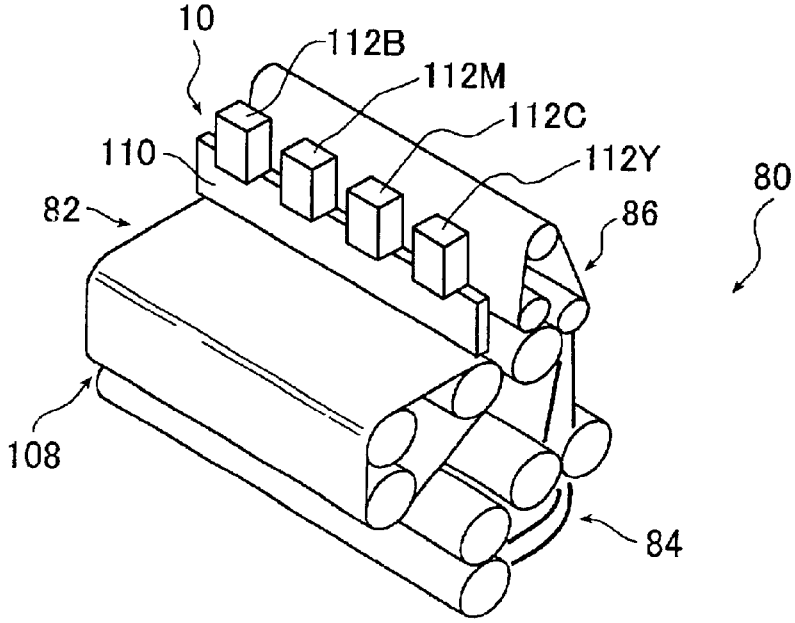
FIG. 7B is a perspective view of FIG. 7A.

FIGS. 7A and 7B show an example of the ink jet printer of the present invention using the recording head 10 of the present invention. FIG. 7A is a conceptual drawing (side view) as seen from the nozzle row direction showing the construction of this ink jet printer, and FIG. 7B is a conceptual drawing (perspective view) of this ink jet printer.

The ink jet printer 80 shown in FIGS. 7A and 7B (hereinafter referred to as the printer 80) uses a line head having a nozzle row extending beyond one direction of the recording paper P corresponding thereto as the recording head 10. This printer 80 is basically a well-known ink jet printer except that it uses the recording head 10 of the present invention.

The printer 80 shown in FIGS. 7A and 7B comprises a recording section 82 using the recording head 10 of the present invention, a sheet feeding section 84, a preheating section 86, a discharging section 88 (not shown in FIG. 7B), and a maintenance unit 90.

The sheet feeding section 84 has conveying roller pairs 92 and 94, and guides 96 and 98, and the recording sheet P is conveyed upwards from the lateral direction by the sheet feeding section 84, and supplied to the preheating section 86.

The pre-heating section 86 has a conveyor 100 composed of three rollers and an endless belt, a press contact roller 102 pressed against the endless belt from outside the conveyor 100, a heater 104 pressed against the press contact roller 102 (endless belt) from inside the conveyor 100, and a ventilating fan 106 for ventilating the interior of the pre-heating section 86 (the interior of the housing 86*a*).

This pre-heating section 86 heats the recording sheet P before performing image recording by ink jet to expedite the drying of the ink. The recording sheet P conveyed from the sheet feeding section 84 is heated by the heater 104 while being held and conveyed by the conveyor 100 and the press contact roller 102, and is conveyed to the recording section 82.

The recording section 82 comprises a head unit 110 on which the recording head 10 of the present invention is mounted and a recording/conveying unit 108. Further, ink tanks 112 (112Y, 112C, 112M, and 112B) are attached to the head unit 110. The pressure adjustor 111 for adjusting the pressure of the ink for use in the present invention is provided between each tank 112 and the head unit 110.

The recording/conveying unit 108 comprises a conveyor 120 consisting of rollers 114*a* and 114*b*, an attraction roller 116 and a porous endless belt 118, a nip roller 122 (not shown in FIG. 7B) pressed against the porous endless belt 118 (roller 114*a*), and an attraction box 124 arranged inside the conveyor 120.

The recording head 10 is attached to the lower end of the head unit 110 (the recording sheet P side illustrated in the lower portion of FIG. 7A) with the nozzles 20 directed toward the attraction roller 116. The recording/conveying unit 108 conveys the recording sheet P continuously at a predetermined speed in a direction perpendicular to the nozzle rows. Thus, the entire surface of the recording sheet P supplied from the pre-heating section 86 is scanned by the nozzle rows of the recording head 10 as a line head to thereby record an image. It should be noted here that the ink level during image recording in the nozzles 20 of the recording head 10 according to the present invention is retained, for example, at an ink level position during ejection that has been predetermined based on the adjustment of the ink internal pressure by means of the pressure adjustor 111.

The conveyor 120 has the porous endless belt 118 and further the attraction roller 116 and the attraction box 124. Thus, the recording sheet P is conveyed in a state in which it is attracted by the porous endless belt 118 and the image is recorded thereon in a state in which it is correctly held at a predetermined position with respect to the recording head 10.

The recording sheet P on which the image has been recorded is supplied to the discharging section 88, and conveyed by a conveying roller pair 126 and discharging rollers 128 to be discharged onto, for example, a discharge tray (not shown).

Figure 8A:
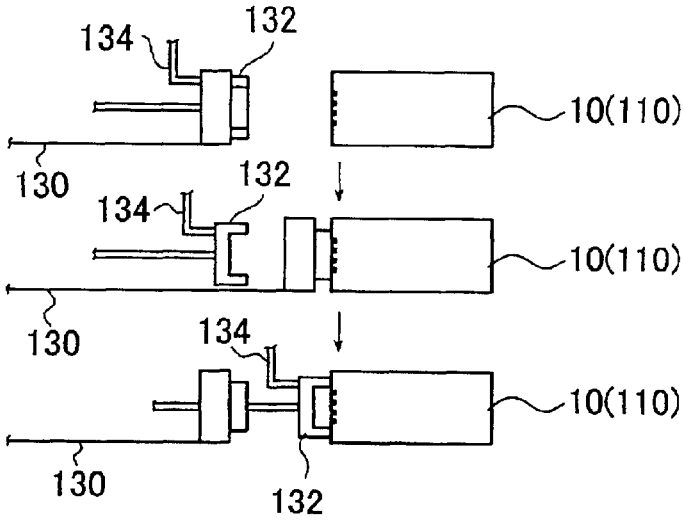
FIG. 8A is a conceptual side view of a maintenance unit for the ink jet printer shown in FIGS. 7A and 7B.
Figure 8B:
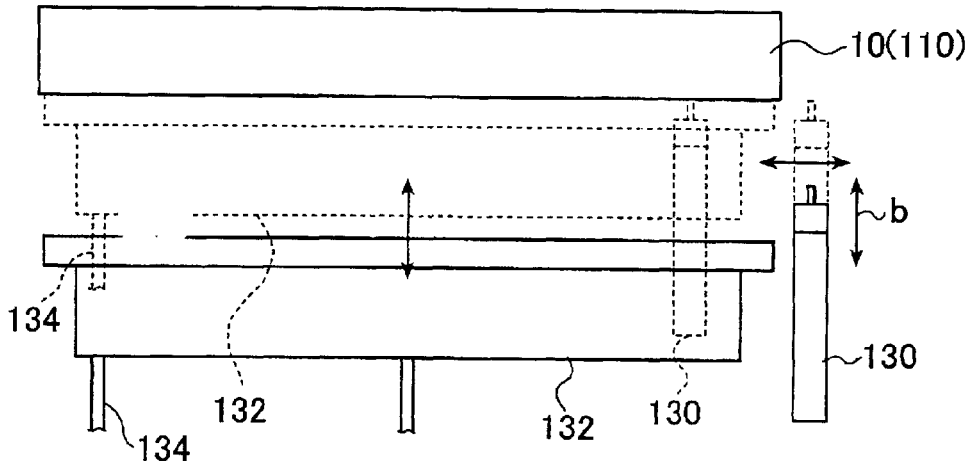
FIG. 8B is a front view of FIG. 8A.
Figure 9:
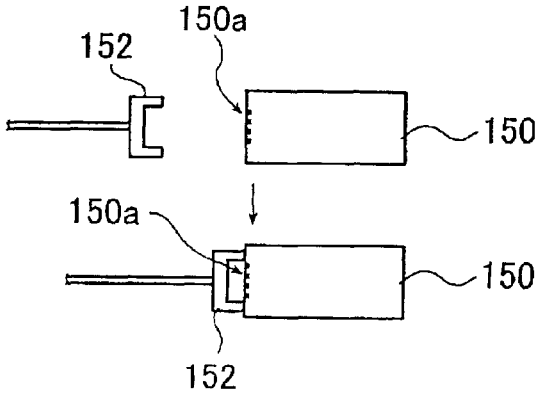
FIG. 9 PRIOR ART
FIG. 9 is a conceptual drawing showing how capping is effected on a conventional ink jet printer.

The maintenance unit 90 performs cleaning and capping on the recording head 10 when, for example, the printer 80 is turned off, and has, as shown in the conceptual drawings of FIGS. 8A and 8B, a wiper 130 and a cap 132.

FIG. 8A is a side view of the maintenance unit 90 as seen from the nozzle row direction, and FIG. 8B is a front view as seen from a direction perpendicular to the nozzle row direction.

In the printer 80 of the example shown, the conveyor 120, the nip roller 122, the attraction box 124, and the conveying roller pair 126 are formed into an integral unit. This unit including the conveyor 120 can be moved to the position indicated by the dotted line in FIG. 7A by rotating it by 90 degrees around the rotation axis of the roller 114*a* of the conveyor 120 (as indicated by the arrow a) according to a well-known method.

The maintenance unit 90 is situated below the head unit 110, and can be raised and lowered by a well-known method (as indicated by the arrow b).

When the printer 80 is turned off, the above-mentioned unit including the conveyor 120 is first moved to the position indicated by the dotted line.

Then, as shown in FIGS. 8A and 8B, the maintenance unit 90 situated at the standby position (See FIG. 7A) is raised to a predetermined position (as indicated by the dotted line), and, further, the wiper 130 alone is further raised and moved in the nozzle row direction of the recording head 10 to thereby clean the nozzles 20 (as indicated by the dotted line in FIG. 8B).

In the printer 80, the cleaning of the recording head 10 can be performed as needed; it can also be performed when the printer is on.

When the cleaning has been completed, the wiper 130 is lowered. Then, the cap 132 is raised, and abuts the surface of the orifice plate 22 in a state in which it completely covers the nozzle rows (as indicated by the dotted line in FIG. 8B), whereby the surface of the orifice plate 22 is hermetically covered, effecting capping on all the nozzles 20. Further, a suction pump is connected to the cap 132 and sucks the interior of the cap 132 as needed.

The recording head 10 of the present invention is then in the standby (storage) state. For example, the ink level is raised to the standby (storage) level as shown in FIG. 2B, based on the pressure adjustment in the ink supply passage that is made by the pressure adjustor 111.

As stated above, in the recording head 10 of the present invention, when the ink level is set higher (downstream side) for the standby (storage) period, it is possible to provide a unit for supplying ink to the nozzle 20 during the standby (storage) period, and this cap 132 may be utilized for the ink supplying unit.

For example, as shown in FIGS. 8A and 8B, it is possible to connect to the cap 132 a supply pipe 134 for supplying ink to the interior of the cap; when the suction as mentioned above has been completed, ink is supplied to the interior of the cap 132 through this supply pipe 134 to fill the interior with ink, thereby attaining the standby (storage) state. In this case, there is no need to perform liquid level control utilizing pressure or the like. It is also possible to use both the suction pipe for sucking the interior of the cap 132 and the ink supply pipe.

The ink jet printer of the present invention is not restricted to the above-described example, and it is possible to utilize various types of well-known ink jet printers. For example, it may be a carriage type printer in which the recording sheets are intermittently conveyed and in which scanning with the recording head (head unit) is effected by a carriage. Further, the printer may be equipped with a feeder for automatically supplying recording sheets.

The above detailed description of the embodiments of the liquid ejecting device and the ink jet printer of the present invention should not be construed restrictively. Various improvements and modifications are naturally possible without departing from the scope of the present invention.

For example, while in the example shown the respective ink levels for the driving period and the storage period are set at some midpoints in the nozzles 20 for ejecting ink droplets, this should not be construed restrictively. In the present invention, the liquid level for the storage period may be set in the ink supply passage on the upstream side of the nozzle.

As described in detail above, according to the first aspect of the present invention, there is provided a liquid ejecting device which ejects liquid droplets through nozzles, wherein different liquid levels are set for the driving and storage periods, whereby nozzle plugging can be advantageously prevented. By applying this device, for example, to an ink jet recording head, it is possible to prevent over a long period of time a reduction in ink ejection amount or nozzle plugging due to ink precipitation in the nozzles, thereby realizing an ink jet recording head having a long service life.

An ink jet printer according to the second aspect of the present invention utilizes the liquid ejecting device according to the first aspect of the present invention and can have a long service life.

What is claimed is:

1. A liquid ejecting device comprising:

a member in which a plurality of nozzles are formed;

a plurality of ejecting units each of which is formed in correspondence with each of said plurality of nozzles and ejects a liquid droplet from each of said plurality of nozzles; and a plurality of supply passages each of which supplies liquid to each of said plurality of ejecting units, wherein a first liquid level position for a driving period and a second liquid level position for a storage period which are different from each other are set such that said second liquid level position for a storage period is contained within in each of a plurality of liquid flow passages comprising each of the plurality of nozzles and each of the plurality of supply passages corresponding to said each of the plurality of nozzles.

2. The liquid ejecting device according to claim 1, wherein the first and second liquid level positions for the driving and storage periods are adjusted by a pressure adjustor for adjusting a pressure of said liquid.

3. The liquid ejecting device according to claim 2, wherein said pressure adjustor is provided between a liquid tank and said plurality of supply passages.

4. The liquid ejecting device according to claim 1, wherein a contact angle at which said liquid comes in contact with an inner wall surface of one of said plurality of liquid flow passages at the first liquid level position for the driving period is different from a contact angle formed at the second liquid level position for the storage period.

5. The liquid ejecting device according to claim 1, wherein each of said plurality of liquid of liquid flow passages has a larger section size at the second liquid level position for the storage period at the first liquid level position for the driving period.

6. The liquid ejecting device according to claim 1, wherein the second liquid level position for the storage period is set downstream from the first liquid level position for the driving period in a direction in which the liquid is ejected.

7. The liquid ejecting device according to claim 6, wherein a groove extending in the direction in which the liquid is ejected is formed in an inner wall surface of each of the plurality of liquid flow passages between the first liquid level position for the driving period and the second liquid level position for the storage period.

8. The liquid ejecting device according to claim 6, wherein the liquid is supplied during the storage period through each of said plurality of supply passages or a separately provided liquid supply unit or both of them.

9. The liquid ejecting device according to claim 1, wherein said liquid is ink, said liquid droplet is an ink droplet, and said liquid ejecting device is an ink jet recording head.

10. An ink jet printer having an ink droplet ejecting device as an ink jet recording head, said ink droplet ejecting device comprising:

a members in which a plurality of nozzles are formed;

a plurality of ejecting units each of which is formed in correspondence with each of said plurality of nozzles and ejects an ink droplet from each of said plurality of nozzles; and a plurality of supply passages each of which supplies ink to each of said plurality of ejecting units, wherein a first ink level position for a driving period and a second ink level for a storage period which are different from each other are set such that said second liquid level position for a storage period is contained within each of a plurality of nozzles and each of the plurality of supply passages corresponding to said each of the plurality of nozzles.

11. The ink jet printer according to claim 10, wherein the first and second ink level positions for the driving and storage periods are adjusted by a pressure adjustor for adjusting pressure of said ink.

12. The ink jet printer according to claim 10, wherein each of said plurality of ink flow passages has a larger section size at the second ink level position for the storage period than at the first ink level position for the driving period.

13. The ink jet printer according to claim 10, wherein the second ink level position for the storage period is set downstream from the first ink level position for the driving period in a direction in which the ink is ejected.

14. The ink jet printer according to claim 13, wherein a groove extending in the direction in which the ink is ejected is formed in an inner wall surface of each of the plurality of ink flow passages between the first ink level position for the driving period and the second ink level position for the storage period.

15. The ink jet printer according to claim 13, wherein the ink is supplied during the storage period through each of said plurality of supply passages or a separately provided ink supply unit or both of them.

16. The ink jet printer according to claim 11, wherein said pressure adjustor is provided between an ink and said plurality of supply passages.

17. The ink jet printer according to claim 10, wherein a contact angle at which said ink comes in contact with an inner wall surface of one of said plurality of ink flow passages at the first ink level position for the driving period is different from a contact angle formed at the second ink level position for the storage period.

* * * * *

UNITED STATES PATENT AND TRADEMARK OFFICE

CERTIFICATE OF CORRECTION

PATENT NO. : 6,749,283 B2
DATED : June 15, 2004
INVENTOR(S) : Sanada

It is certified that error appears in the above-identified patent and that said Letters Patent is hereby corrected as shown below:

Column 13,
Line 14, please replace "contained within in each of a plurality…" with -- contained within each of a plurality --.

Signed and Sealed this

Sixteenth Day of November, 2004

JON W. DUDAS
*Director of the United States Patent and Trademark Office*